United States Patent [19]

Gepfer

[11] 3,942,709

[45] Mar. 9, 1976

[54] STABILIZED CONTAINER DIVIDER

[75] Inventor: Richard E. Gepfer, Brookfield, Wis.

[73] Assignee: Clevepak Corporation, New York City, N.Y.

[22] Filed: Jan. 2, 1975

[21] Appl. No.: 537,945

[52] U.S. Cl. ..... 229/15; 217/31
[51] Int. Cl.[2] ..... B65D 5/48; B65D 25/04
[58] Field of Search ..... 229/15; 217/15, 21, 22, 217/23, 31, 32

[56] References Cited

UNITED STATES PATENTS

| | | | |
|---|---|---|---|
| 1,313,948 | 8/1919 | Maegly | 217/31 X |
| 2,349,364 | 5/1944 | Marshall | 229/15 |
| 2,920,782 | 1/1960 | Butters | 229/15 X |
| 3,203,612 | 8/1965 | Schaeffer | 229/15 |
| 3,343,742 | 9/1967 | Siegler | 229/15 |

*Primary Examiner*—Davis T. Moorhead
*Attorney, Agent, or Firm*—Rogers, Ezell & Eilers

[57] ABSTRACT

A divider used in containers formed of cardboard or like material has intersecting partitions and a tying strip attached to the ends of the partitions and adapted to lie adjacent to the wall of a container. The tying strip holds the partitions substantially parallel so that the divider may be inserted by machine into a container and will remain in a fixed spacial relationship while the container is filled with goods by automatic casing machinery. The partitions and the tying strip have transverse cuts and are joined by interlocking the cuts into a rectilinear network. The corners of the partitions and the openings to the cuts are relieved to allow ease of assembly of the partitions and strip and of insertion of the completed divider into a container by automatic machinery. The portions of the partitions which are joined to the tying strip are folded over and glued to provide additional strengthening elements which increase the strength of the divider and boxes using the divider. The partitions are formed by cutting and scoring cardboard stock on conventional die cutting machines and by applying glue to a portion of the partitions at a location near one end of the strip. The glued partitions are then assembled with a pre-cut tying strip and the glued portions are adhered to the tying strip by folding the interlocking parts together.

14 Claims, 9 Drawing Figures

STABILIZED CONTAINER DIVIDER

BACKGROUND AND SUMMARY OF THE INVENTION

Cardboard dividers are commonly used in containers, such as cardboard boxes and crates, to divide the interior of the containers into a plurality of sections for receiving goods, such as cans, bottles, or other articles, which require protection in storage and transit. These dividers are commonly inserted in a container by automatic machines and the container carrying the divider is then filled, usually also by an automatic casing machine.

Use of automatic casing machines, in particular, has caused some difficulty with containers which have used previous cardboard dividers. The dividers must divide the interior of the container into equal volumetric sections and there must be no distortion or racking of the divider. If the divider is distorted or racked, it is not possible for the casing machine to insert the articles into the case since the articles will not index properly with the assigned space due to the unexpected shape of the divider.

Prior dividers attempted to solve the problem of accurately spacing the divider by using a dead cell construction in which the ends of partition strips or elements extended past the location of the articles and spaced the partition strips and the articles in the container from the walls of the container. The partitions were tied together by overlapping the ends of the partitions.

This dead cell construction is wasteful of material since the containers are considerably larger than the total volume of all the articles contained therein. Dead cell construction also weakens the container and allows the walls of the container to collapse from impact or from the weight of other stacked containers.

Applicant's divider eliminates the necessity of a dead cell in the container, eliminates unnecessary consumption of packaging, and increases the stacking strength of containers using the divider.

Applicant's divider may be readily manufactured, assembled and inserted into containers using automatic machinery and is readily adapted to use in automated casing processes.

The divider eliminates the use of dead cells by joining a tying strip to the ends of the partitions, thereby placing the tying strip immediately adjacent to the wall of the container in which the divider is placed. The tying strip is fastened to the ends of the partitions and holds the partitions in a substantially parallel relationship so that they are not able to rack or distort about their intended location in a container. Portions of the partitions are joined to the tying strip, preferably by a glue seam.

The folded over portions of the partitions form portions of increased thickness at the locations where they are joined to the tying strip and increase the vertical compressive strength of the divider and the container in which the divider is placed. A container using the divider has the tying strip and the portions of increased thickness immediately adjacent to the wall of the container. The container containing the divider and goods located in the spaces of the divider, has increased strength since there are no dead cells into which the walls of the container can buckle or outside forces can penetrate. The folded portions also add increased vertical strength. Material for packaging is conserved, since the box does not need to be oversized to compensate for the unused dead cell space previously necessary to provide a stable divider.

DESCRIPTION OF THE PREFERRED EMBODIMENT

Figure 1:
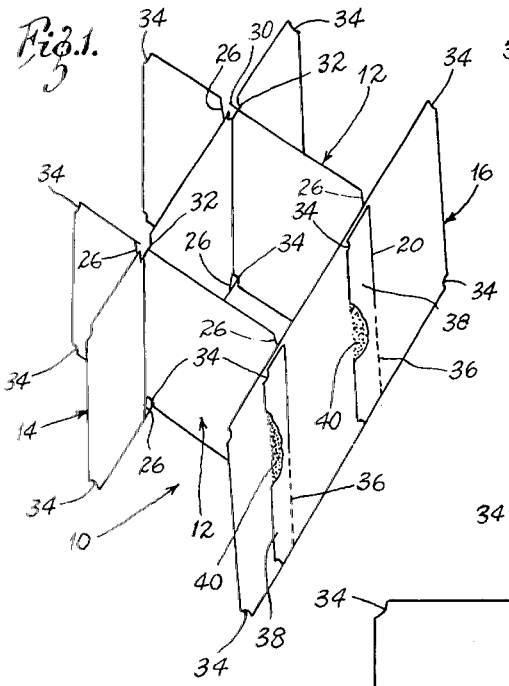
FIG. 1 is an isometric view of an assembled divider according to the invention.
Figure 2:
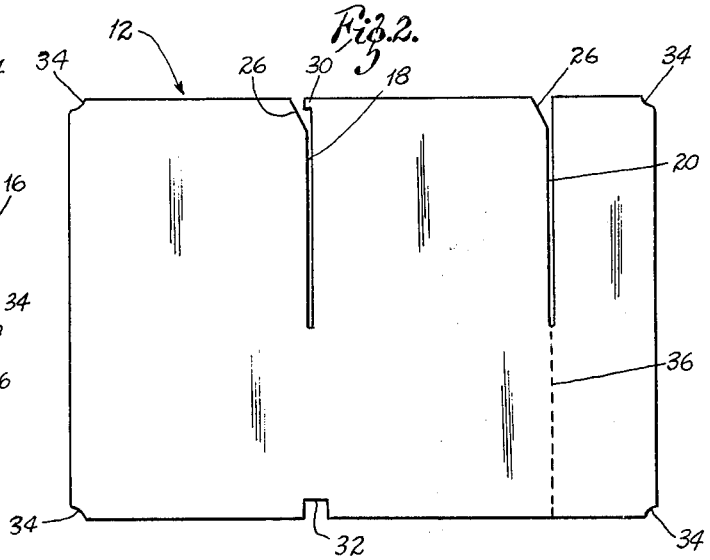
FIG. 2 is a plan view of a partition according to one aspect of the invention.
Figure 3:
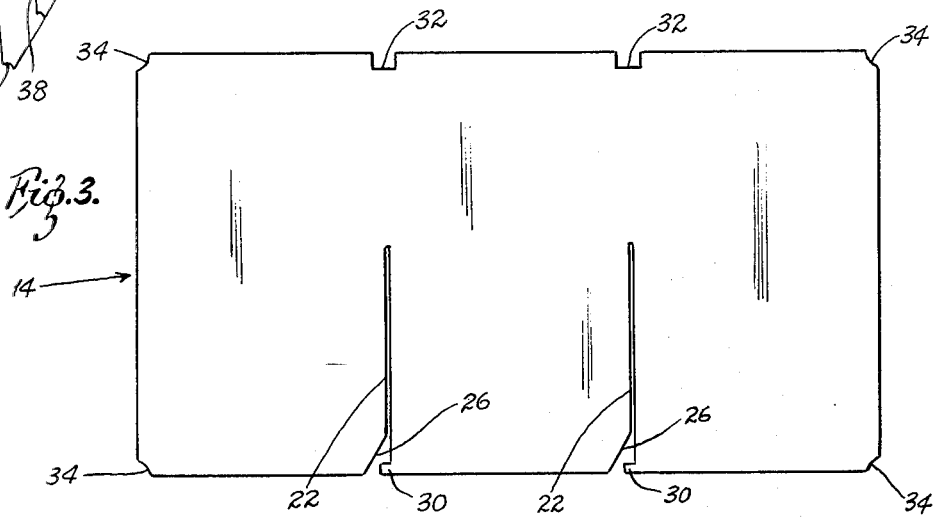
FIG. 3 is a plan view of a cross partition.
Figure 4:
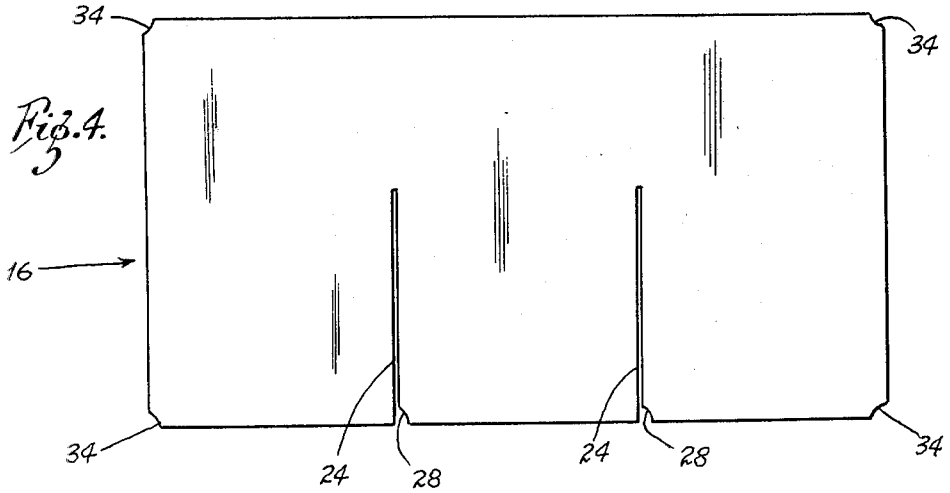
FIG. 4 is a plan view of the tying strip.

Referring in more detail to the drawings, a divider 10, shown in FIG. 1, has two parallel partitions 12, an intersecting cross partition 14, and a tying strip 16 which form a six-section divider. Partitions 12 have parallel slots 18 and 20 cut partially through the partitions, as shown in FIG. 2. Slot 18 is located at approximately the center of the partition 12, and the second slot 20 is located near one end of the partition. Cross partition 14 has two slots 22 extending halfway through the vertical extension of the cross partition, as shown in FIG. 3. The slots are located to divide the cross partition approximately in thirds. Tying strip 16 also has two slots 24 similar to slots 22 of cross partition 14, as shown in FIG. 4. Slots 24 are spaced to divide the tying strip approximately in thirds.

Partitions 12 and cross partition 14 have the entrance to slots 18, 20 and 22 relieved by a triangular cut 26 at the upper edge of the partitions 12 and 14 to facilitate insertion and assembly of the partitions and the cross partition 12 and 14 into the slots 18, 20 and 22. Tying strip 16 has smaller relieved areas 28 to facilitate assembly of the complete divider.

Partitions 12 and cross partition 14 have a locking protrusion 30 at the edge of the partition adjacent to the entrance to slots 18 and 22. A relieved portion 32 is located at the opposite edge of partitions 12 and cross partition 14 from the slots 18 and 22. Relieved portion 32 and locking extension 30 cooperate to hold partitions 12 and cross partition 14 together when the partitions are assembled in an interlocking position. The protrusion 30 extends across the partitions and through relieved area 32 to form a lock abutting against the partitions and preventing any substantial relative motion between the partitions 12 and 14 in a direction parallel to slots 18, 20 and 22. Cooperating means 30 and 32 also restrict relative longitudinal motion perpendicular to slots 18, 20, and 22, between partitions 12 and 14. All of the elements 12, 14 and 16 have relieved portions 34 at their corners which permit ease of insertion of the complete assembly into a container.

Partitions 12 are scored at 36 along the vertical extension of slot 20 and have areas 38 located between slots 20 and score lines 36 and the outer end of the partitions. In the complete assembly, as shown in FIG.

1, portions 38 extend beyond tying strip 16, are folded over parallel to the outermost side of tying strip 16, and are adhered to tying strip 16 by glue bond 40. Elements 38, when adhered to the back, or outer, side of tying strip 16, form areas of increased thickness in the tying strip 16, which increase the vertical compressive strength of the divider and of a carton with the divider included therein. By folding the elements 38 tightly adjacent to the tying strip 16, the tying strip can be spaced closely adjacent to the walls of a container, thereby eliminating a dead cell space which would allow the walls of the container to collapse into the interior of the container.

Figure 9:
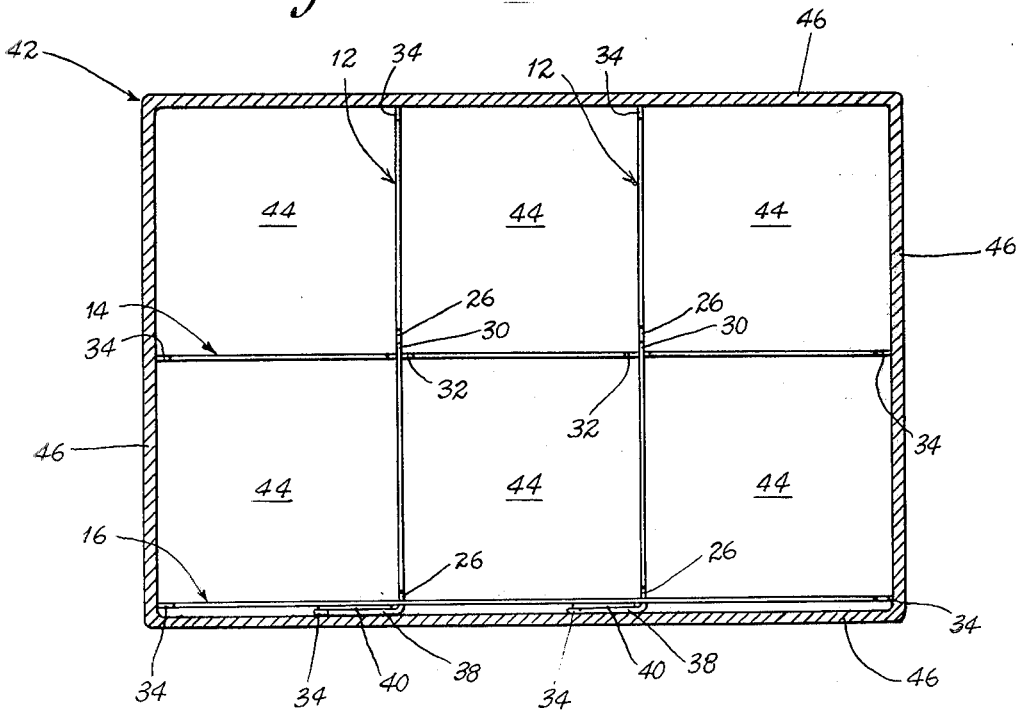
FIG. 9 is a top view partially in section of a container containing the assembled divider.

By joining the elements 38 of partitions 12 to the tying strip 16, the partitions 12 are held in a substantially parallel relationship so that they do not rack about in the interior of the container and the divided areas of the container remain substantially equal. The spaces are thus susceptible to being filled rapidly by automatic casing machinery. FIG. 9 shows a container 42 having the divider 10 included therein to divide up the interior of the container 42 into six equal volume spaces 44.

To form applicant's reinforced and stabilized divider 10, elements 12, 14 and 16 are cut by conventional methods, such as reciprocating punches and dies, to form slots 18, 20, 22, 24; relieved areas 26, 28, 32 and 34; and outward extending portions 30. Scores 36 are made along the extensions of slots 20. Glue bond 40 is spread in area 38 by conventional means, such as glue brush and pot, a pneumatic glue gun, or other conventional applicator. Glue bond 40 can also be applied to the back side of tying strip 16 adjacent slots 24, if desired.

Figure 5:
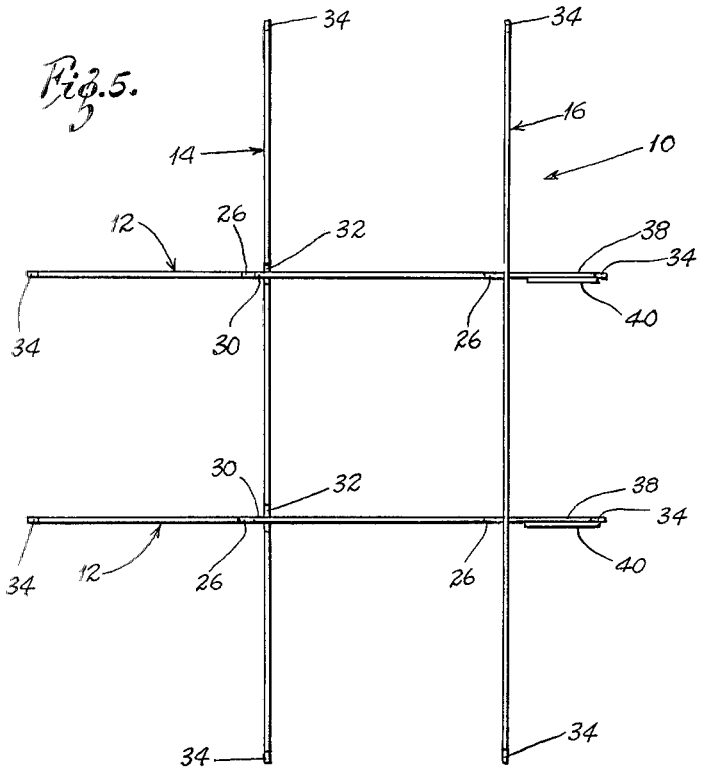
FIG. 5 is a top view of a partially assembled divider such as that shown in FIG. 1.
Figure 6:
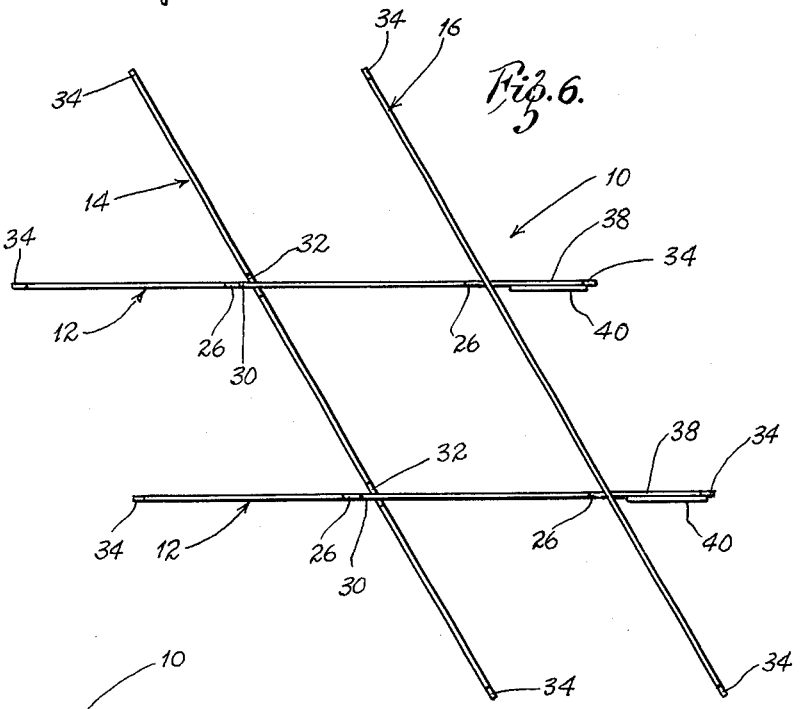
FIGS. 6 and 7 are views of the divider during steps of the assembly of the divider to join the tying strip and partitions.
Figure 7:
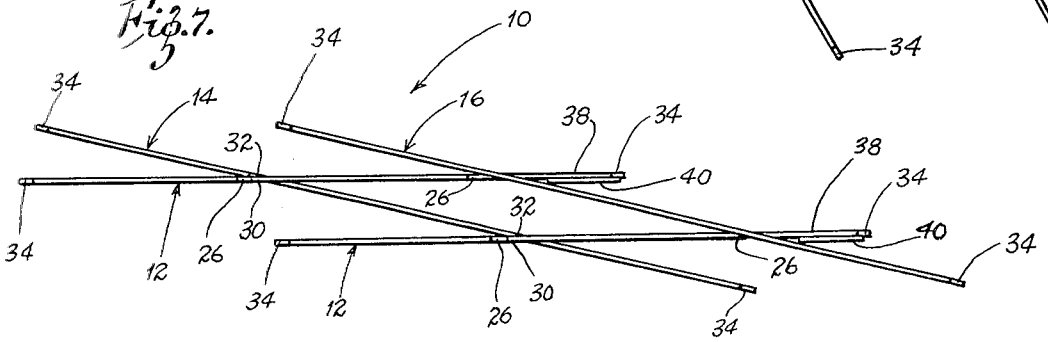
Figure 8:
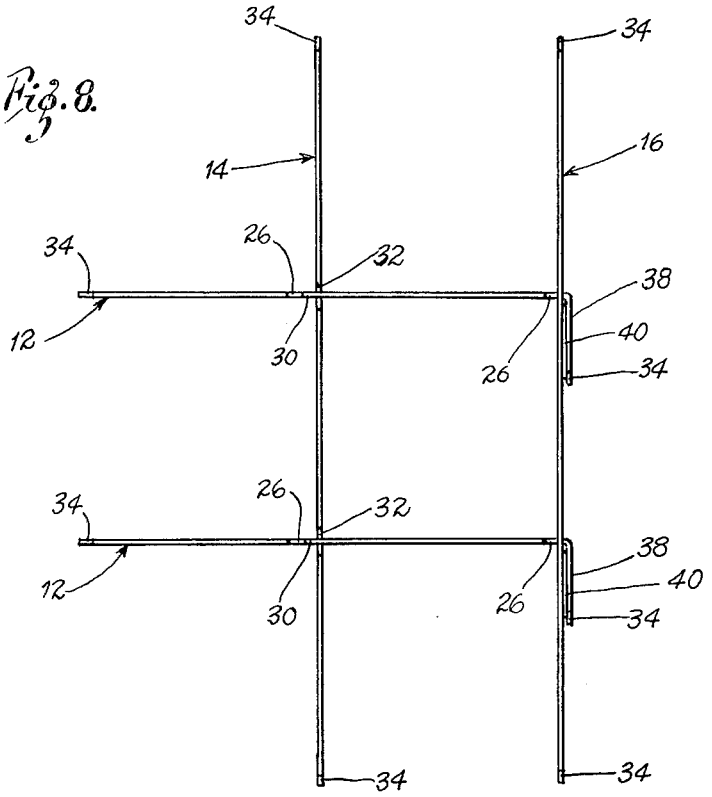
FIG. 8 is a top view of an assembled, joined divider.

Elements 12, 14 and 16 are assembled with slots 18, of partitions 12 interlocking with slots 22 of partition 14 and with slots 20 of partitions 12 interlocking with slots 24 of tying strip 16, as shown in FIG. 5. The assembled divider 10 is then collapsed, as shown in FIGS. 6 and 7, so that glue bond 40 on portions 38 of partitions 12 adheres to the outer side of tying strip 16. After areas 38 of partitions 12 have been adhered to strip 16, the divider 10 is then expanded to its normal configuration, as shown in FIG. 8, with portions 38 firmly adhered to the outer side of partition 16. The assembled divider 10 can be inserted in a container such as cardboard container 42 by an automatic machine. Tying strip 16 will hold partitions 12 and 14 in a fixed stable relationship with areas 44 maintained substantially uniform. Articles may be rapidly inserted into the areas 44 by automatic casing means.

It will be appreciated by those skilled in the art that many modifications and alternative constructions could be used incorporating the invention without departing from the basic concepts thereof. It is intended that the invention is not to be limited by the description included herein for the purposes of illustration, but is to be limited only by the scope of the appended claims.

I claim:

1. A divider for use in the container to divide the internal space of the container having a partition extending in the first direction and a tying strip extending in a direction intersecting the partition, the partition and the tying strip being joined so that an end of the partition is connected to an intermediate portion of the tying strip and wherein the partition and tying strip have interengaging slots which are interlocked at the point of intersection, the partition being scored along the vertical extension of its slot and having a portion of the partition extending past the point of intersection folded along the score, the folded portion being joined to the tying strip and forming a reinforcing member.

2. The divider of claim 1 wherein the partition is joined to the tying strip by a glue bond between the folded portion of the partition and the tying strip.

3. The divider of claim 1 wherein there are a plurality of partitions.

4. The divider of claim 3 wherein there are a plurality of partitions and the tying strip and at least some of the partitions are joined to maintain at least some of the partitions substantially parallel.

5. The divider of claim 4 wherein there is at least one additional partition intersecting the partitions joined to the tying strip at a location space from the tying strip, the additional being substantially parallel to the tying strip.

6. The divider for dividing the internal space of a container having a plurality of partitions extending in the first direction and means retaining the partitions in a substantially parallel relationship, wherein the means retaining the partition strips in substantially parallel relationship includes a tying strip joining the ends of the partition strips, the partition strips being connected thereto at intermediate locations along the length of the tying strip, at least some of the partitions having slots extending partially along the vertical extension of the partitions and spaced adjacent to the ends of the partitions, the remainder of the slotted partitions along the vertical extension of the slots being scored, the slots of the slotted partitions being interlocked with cooperating slots in the tying strip and the slotted partitions having portions extending past the points of intersection with the tying strip which are folded about the scores and fastened to the tying strip, the divider having an additional element intersecting the partition at a location spaced from the tying strip, the additional element and partitions having cooperating interlocking slots and holding means to stabilize the divider from undesired movement, the additional element being substantially parallel to the tying strip.

7. A method of producing a reinforced divider having a tying strip comprising cutting a first partition, applying glue to a portion of the first partition at a location near one end of the partition, cutting a second partition, assembling the first and second partitions, and joining the first and second together by the glued portion of the first partition.

8. The method of claim 7 wherein a third partition is cut, scored, and coated with glue at a location near one end of the partition and assembled with the first and second partitions, and wherein the third partition is joined to the second partition by the glued portion of the third partition.

9. The method of claim 8 wherein the first and third partition are held substantially parallel by the second partition.

10. The method of claim 8 wherein additional partitions are added to the assembly.

11. The method of claim 7 wherein the partitions are joined by collapsing the assembly.

12. The method of producing a reinforcing stabilized divider comprising cutting a plurality of partitions, scoring the partitions in a location adjacent to an end of the partitions, applying glue to areas of the partitions adjacent to the scored locations, cutting a tying strip, assembling the partitions and tying strip, joining the partitions to the tying strip by the glued portions of the partitions to maintain the partitions in a substantially parallel relationship.

13. The method of claim 12 wherein the glued portions of the partitions are located to reinforce the divider.

14. The method of claim 12 wherein the divider has additional interconnecting means.

* * * * *